United States Patent [19]

Stirling

[11] Patent Number: 4,917,577

[45] Date of Patent: Apr. 17, 1990

[54] HIGH SPEED CENTRIFUGAL OXYGENATOR

[75] Inventor: Thomas E. Stirling, Sugarloaf, Pa.

[73] Assignee: Barrett, Haentjens & Co., Hazelton, Pa.

[21] Appl. No.: 301,443

[22] Filed: Jan. 25, 1989

[51] Int. Cl.[4] ..... F04F 11/00

[52] U.S. Cl. ..... 417/66; 417/70; 417/158; 415/225; 415/121.1; 261/93

[58] Field of Search ..... 417/65, 66, 70, 71, 417/158, 84, 89; 415/116, 117, 206, 225, 226, 204, 215, 218.1, 212.2, 121.1

[56] References Cited

U.S. PATENT DOCUMENTS

| | | | |
|---|---|---|---|
| 35,604 | 6/1862 | Guild | 415/225 |
| 2,233,825 | 3/1941 | Walsh et al. | 415/225 |
| 2,544,813 | 3/1951 | Wall | 415/218.1 |
| 2,575,568 | 11/1951 | Topanelian, Jr. | 415/218.1 |
| 3,365,178 | 1/1968 | Bood | 261/25 |
| 3,477,581 | 11/1969 | Stearns | 210/195.3 |
| 3,521,864 | 7/1970 | Welles, Jr. | 261/93 |
| 3,663,117 | 5/1972 | Warren | 261/93 |
| 3,918,829 | 11/1975 | Korzec | 415/119 |
| 3,948,492 | 4/1976 | Hege | 366/131 |
| 3,957,663 | 5/1976 | Gatti et al. | 252/43 |
| 4,242,289 | 12/1980 | Blum | 261/93 |
| 4,338,062 | 7/1982 | Neal | 415/225 |
| 4,531,920 | 7/1985 | Stricker | 440/47 |
| 4,702,676 | 10/1987 | Westfall et al. | 417/198 |
| 4,776,753 | 10/1988 | Weinrib | 415/53 R |
| 4,877,532 | 10/1989 | Haentjens | 210/629 |

OTHER PUBLICATIONS

Publication by Anderson entitled, "Centrifugal Pumps", pp. 30–33.

EPA Design Manual Oct. 1985, paragraph 3.2.2, p. 39.

EPA Design Manual Oct. 1985, p. 66.

Publication entitled "Dioxytrol Systems", undated.

*Primary Examiner*—Leonard E. Smith

*Assistant Examiner*—Robert N. Blackman

*Attorney, Agent, or Firm*—Hill, Van Santen, Steadman & Simpson

[57] ABSTRACT

A centrifugal oxygenator pump includes a bottom inlet into an impeller chamber, the bottom inlet having a venturi gas inlet for mixing gas with the in flowing liquid. The impeller chamber is of a frusto-conical shape within which is rotatably mounted a similarly shaped mismatched impeller, the impeller driving the liquid and gas mixture toward a toroidal outlet chamber and through an outlet to an outlet nozzle. The motor drives the impeller to attain a high specific speed so that an increased capacity and larger size oxygenator is provided with maximum efficiency and effectiveness.

3 Claims, 3 Drawing Sheets

12
28
50
54
52
56
58
58
60
34
66
70
36
68
64
74
76
78
82
80
90
88
92
86
87
84
'a'
'b'
62
38
96
98
72
V
V
III
III
IV
IV
99
100
20
102
110
40
106
104
108
22

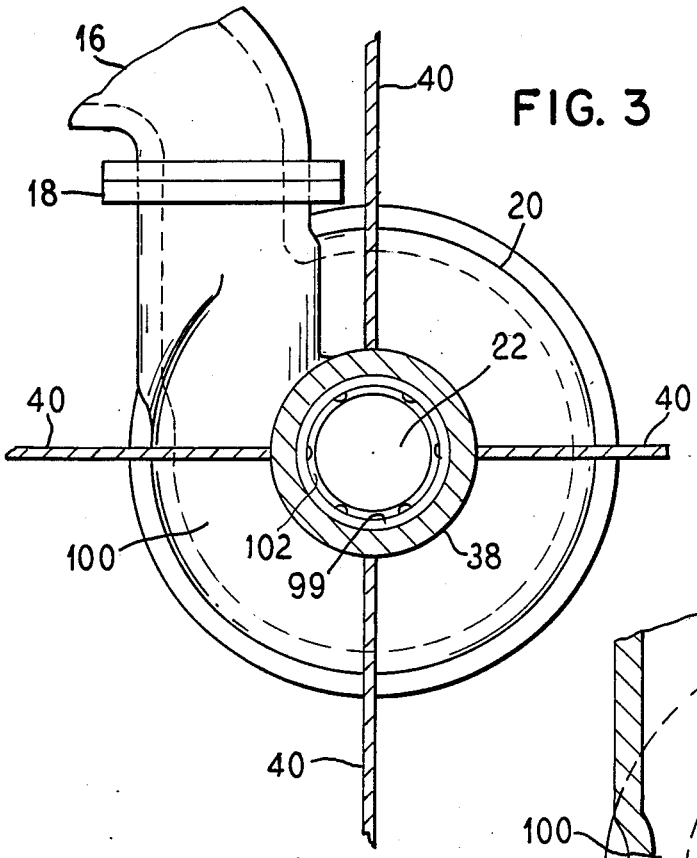
FIG. 3
FIG. 4
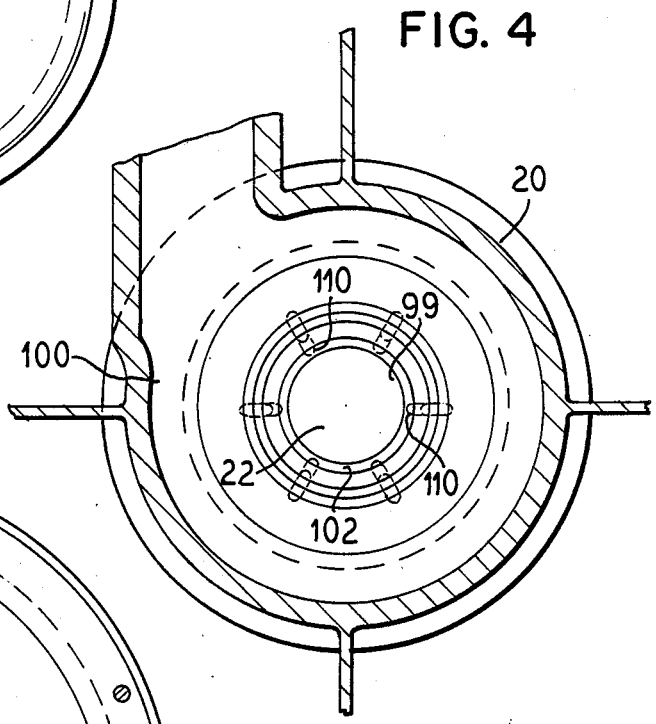
FIG. 5
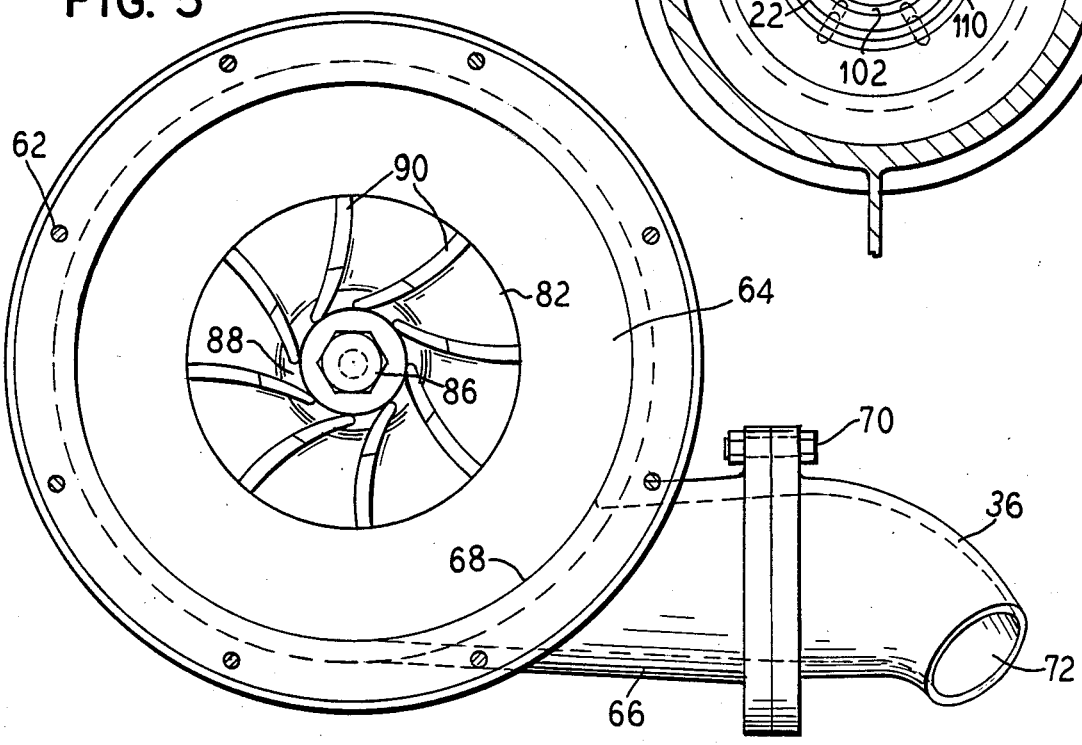

HIGH SPEED CENTRIFUGAL OXYGENATOR

BACKGROUND OF THE INVENTION

1. Field of the Invention

The present invention relates generally to a high specific speed centrifugal oxygenator for mixing a gas into a liquid.

2. Description of the Related Art

Centrifugal oxygenators have been developed for mixing a gas, such as oxygen, into a liquid, such as liquid waste, for absorption of the oxygen by the waste. One type of centrifugal oxygenator includes a venturi type inlet for air or oxygen which encircles a waste water inlet in a collector to aspirate air or oxygen directly into the wase water as it enters the collector. A recessed vortex type impeller is provided which is mismatched with its casing or collector; in other words having an oversized collector to provide a high agitation rate in the collector. The outlet of the collector is back-pressured by outlet nozzles to extend the duration of retention of the liquid and air mixture in the collector as well as increase the pressure therein. Continuous absorption of oxygen is thereby provided under high agitation and pressure with an extended mixing and retention time.

To increase the capacity of the existing centrifugal oxygenators, several units are run in parallel. However, it is more economical to utilize a single, larger unit instead of a plurality of smaller units in parallel. After testing, it has become apparent that the specific speed range of the known units cannot be used efficiently. If the flow rate is to increase and the nozzle pressure or head generated by the oxygenator is to remain constant, then a lower speed must be used. This is entirely possible, although lower speed units are larger and thus more expensive.

SUMMARY OF THE INVENTION

It is an object of the present invention to provide a centrifugal oxygenator having a high specific speed for increased capacity over the known centrifugal oxygenators. It is another object of the invention to provide a centrifugal oxygenator of improved physical design. Yet a further object of the invention is to increase the efficiency and reduce the cost for a centrifugal oxygenator.

These and other objects of the invention are achieved in a centrifugal oxygenator operable at high specific speed with improve efficiency and increased capacity over the known centrifugal oxygenators. The improved centrifugal oxygenator includes an inlet into the pump through which a first fluid, such as a liquid or gas is drawn. Means for injecting or inducing a second fluid, such as air or oxygen, into the flow of the liquid being drawn into the inlet is provided. The inlet leads into a pump chamber having a frusto-conical shape with the inlet at the frustrum of the chamber. An outlet for the pump chamber is provided at a base thereof and the impeller is mounted for rotation in the pump chamber and is mismatched in size to the pump chamber. Here the term "mismatched" means an impeller and impeller casing which is not matched. A matched impeller and impeller casing is known to those of skill in the art as having structural and operational conditions for achieving maximum efficiency, including having a volume in which the impeller operates corresponding to the size of the impeller casing. In one embodiment, the present impeller has blades which are spaced from the wall of the pump chamber by a distance of between approximately one and a third through four times the width of the blades. In other words, the impeller blade width to casing breadth ratio is in the range of 1:4 to 3:4. The impeller rotates on an axis and is mounted intermediate the inlet and the outlet in a direction on the axis.

BRIEF DESCRIPTION OF THE DRAWINGS

FIG. 3 is a horizontal cross section along line III—III of FIG. 2;

FIG. 4 is cross section along line IV—IV of FIG. 2; and

FIG. 5 is a cross section along line V—V of FIG. 2 of the present centrifugal oxygenator.

DESCRIPTION OF THE PREFERRED EMBODIMENTS

Figure 1:
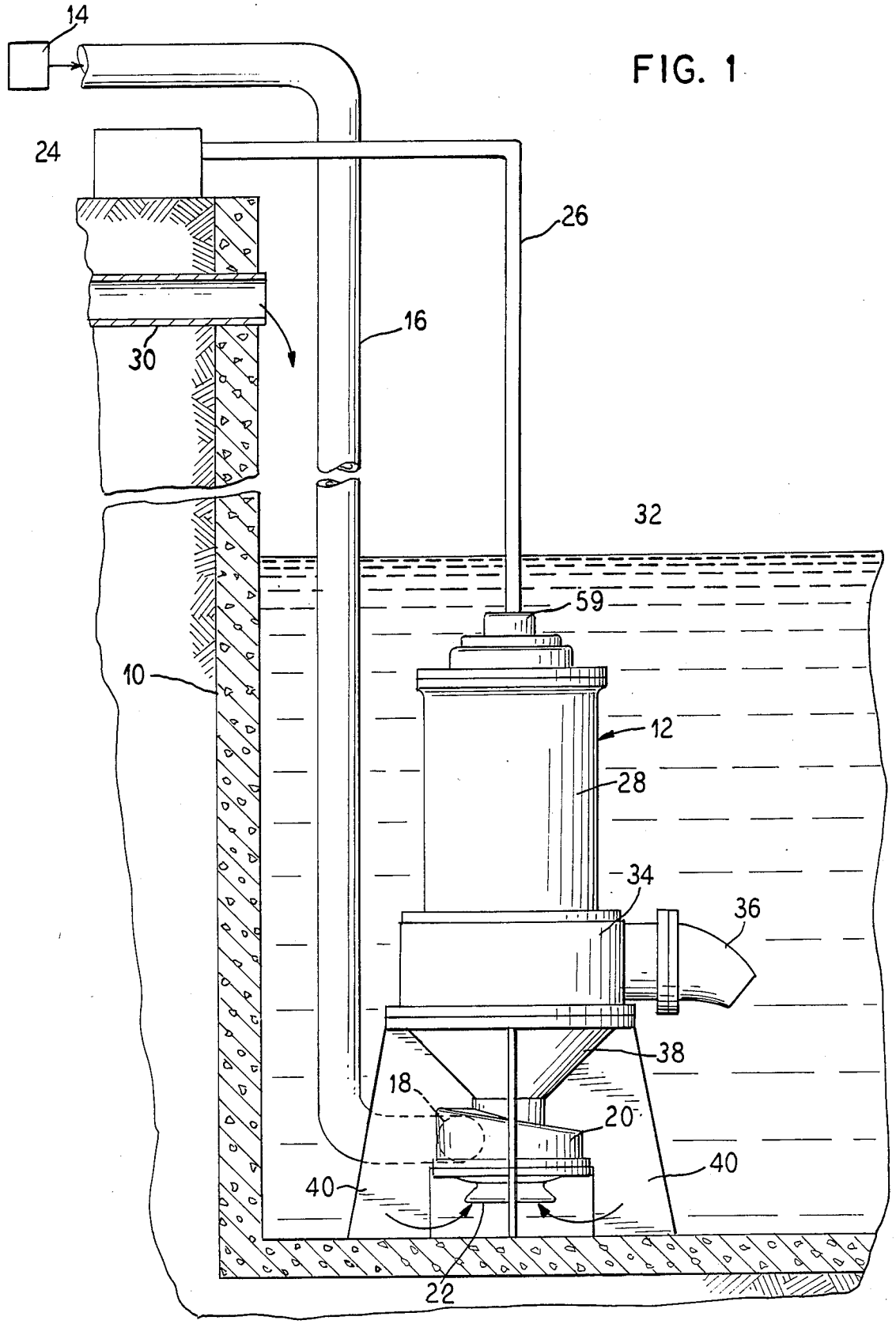
FIG. 1 is a side elevational view of a centrifugal oxygenator of the present invention operating in a liquid basin.

In FIG. 1 of the drawings, there is shown a sewage treatment plant in which the centrifugal oxygenator of the invention is used. The sewage treatment plant includes a tank 10 which may be a conventional tank such as is used for biodegradable sewage treatment systems. An oxygenator 12 is disclosed within the tank 10. A source of oxidizing gas, which may be air or oxygen, is indicated generally at reference numeral 14 mounted externally of the tank 10 and having a connecting conduit 16 in communication with an inlet flange 18 for a venturi housing 20 mounted adjacent an inlet 22 of the centrifugal oxygenator 12.

Also mounted outside of the tank 10 is an electrical power supply and control unit 24 having an electrical cable 26 connected to a motor unit 28 of the oxygenator 12. Extending into the wall of the tank 10 is an inlet pipe 30 for biodegradable material through which liquid waste is fed to attin a liquid level 32 in the tank 10. The liquid level 32 is above the oxygenator 12 including the motor unit 28 so that the apparatus of the invention operates in a submerged condition. This is not required in all cases, however, since the liquid level can fall to a minimum level just above the level of the inlet 22. The liquid level can also reach a maximum depth of, for example, 30 feet above which the venturi inlet 22 ceases to operate effectively as the submergence equals the velocity head at the throat of the venturi inlet.

The centrifugal oxygenator apparatus 12 includes the motor unit 28 mounted to an upper pump housing 34 having an outlet nozzle 36 directed in a somewhat downwardly direction into the tank 10. The upper pump housing 34 is connected to a lower housing portion 38 having a generally frusto-conical configuration, at the frustrum of which is the venturi housing 20 and the inlet 22. The lower housing portion 38 also includes legs 40 extending downwardly for supporting the oxygenator 12 on the lower surface of the tank 10. The legs 40 are preferably plated shaped members arranged radially relative to the inlet 22 so as not to impede liquid flow into the inlet 22. In one embodiment, three support legs 40 are provided while in another embodiment four such legs extend from the lower housing portion 38. Other arrangements or types of support legs are of course possible.

Figure 2:
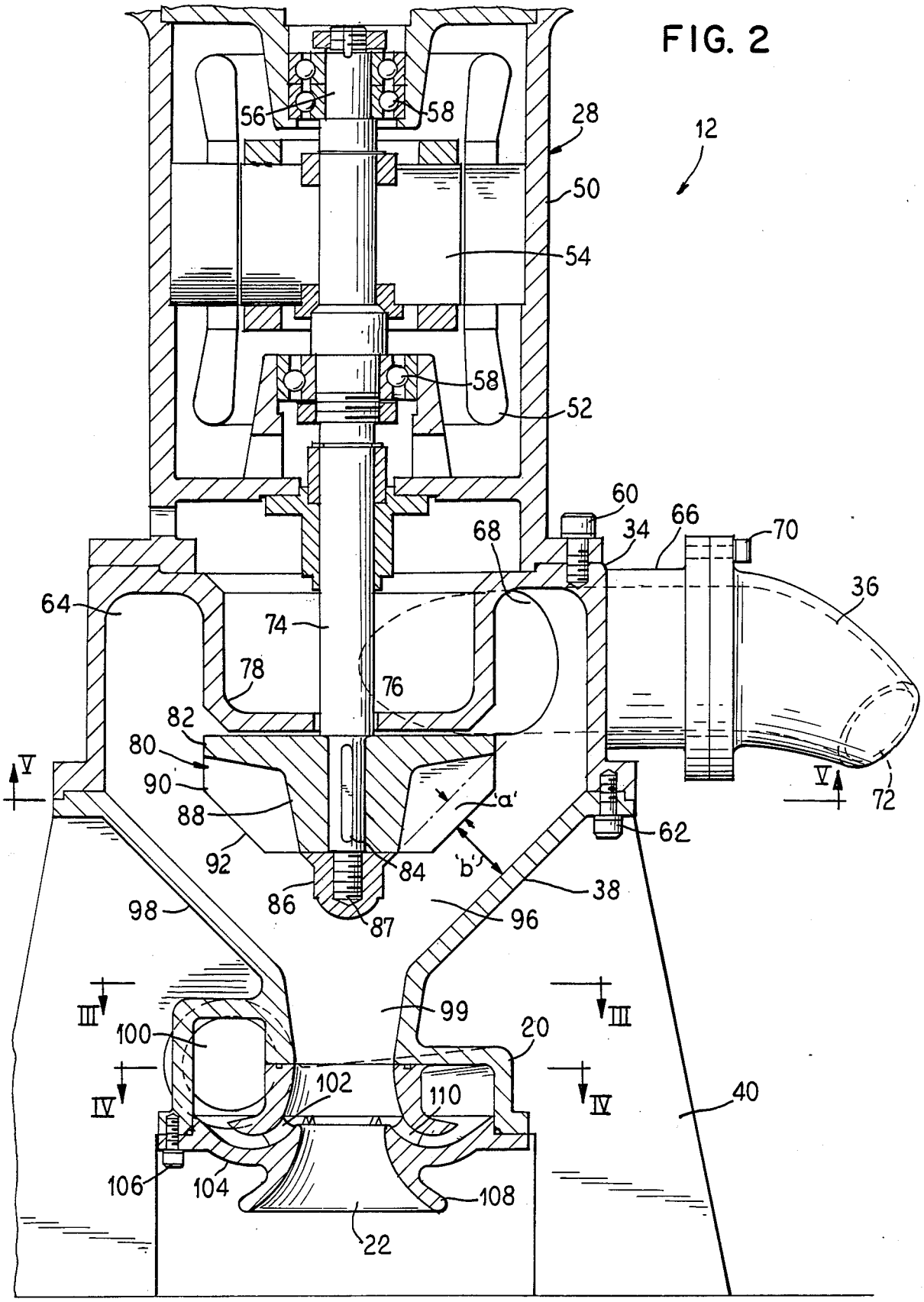
FIG. 2 is an enlarged vertical cross section of the centrifugal oxygenator of FIG. 1.

In the cross section of FIG. 2 can be seen the motor unit 28 which has a motor casing 50 within which is mounted a stator 52 for electromagnetically driving a rotor 54 mounted on a motor shaft 56. The motor shaft 56 rotates within the casing 50 supported by a plurality of bearing assemblies 58. Power to the motor is supplied by the power supply and control unit 24 through the electrical cable 26, as shown in FIG. 1. Preferably, a seal housing 59 shown in FIG. 1 that the electrical connection to the cable 26 is water-tight.

The motor casing 50 is mounted by bolts 60, one of which is shown in FIG. 2, to the upper pump housing 34. The upper pump housing 34 is likewise mounted by bolts 62 to the lower pump housing 38. Within the upper pump housing 34 is formed a toroidal outlet chamber 64 from which extends an outlet 66 at an outlet opening 68. The outlet nozzle 36 is mounted by bolts 70, one of which is shown in FIG. 2, to the outlet 66. As can be seen, a nozzle orifice 72 for the outlet nozzle 36 is of a reduced diameter relative to the outlet 66, thereby increasing back pressure within the centrifugal pump 12.

The motor shaft 56 extends axially into a central opening 76 in the upper pump housing 34. The central opening 76 is in a cup shaped wall portion 78 which defines the central portion of the toroidal outlet chamber 64. A conventional mechanical seal is mounted in housing 74 to prevent leakage of liquid into the motor chamber 50.

Mounted on the impeller shaft 74 is a mismatched impeller 80 having a rear shroud 82 spaced slightly from the bottom surface of the cup shape wall portion 78. A key 84 and cap nut 86 mounted over a threaded extension 87 of the impeller shaft 56 holds the impeller 80 in place for rotation with the shaft 74.

The impeller 80 of the preferred embodiment is a single shroud impeller having the shroud 82 lying adjacent the wall 78 and a central hub 88 extending about the impeller shaft 74. Projecting from the rear shroud 82 and the hub 88 are a plurality of impeller blades 90 which have a beveled or angled outer edge 92 lying at an angle to the axis of the pump. In a preferred embodiment, the beveled or angled edge 92 lies at between 20 and 50 degrees to the axis of the pump.

An effective impeller blade width 'a' is indicated in FIG. 2 as the distance from the outer angled edge 92 of the impeller blade 90 to a line intersecting the outer surfaces of the rear shroud 82 and hub 88. In other words, the effective impeller blade width is the distance 'a' which each impeller extends from the shroud 82 and hub 88.

The lower pump housing 38 is mounted on the upper pump housing 34 to define an impeller chamber 96 lying axially below the toroidal outlet chamber 64 of the present pump. The impeller 80 lies in the impeller chamber 96, although the impeller 80 occupies considerable less of the impeller chamber 96 than in known centrifugal pumps. Walls 98 of the lower pump housing are likewise angled, preferably at between 20 and 50 degrees to the axis of the pump so as to correspond to the angle of the impeller blades 90. The walls 98 of the lower pump housing 38, however, are spaced by a distance 'b' from the outermost edges 92 of the impeller blades 90. In a preferred embodiment, the distance 'b' is between approximately one and a third and four times greater than the effective impeller blade width 'a'. The walls 98 thereby define a frusto-conical shaped impeller chamber 96 within which is mounted a substantially frusto-conical shaped impeller 80.

At the lower end of the lower pump housing 38 is a centrally disposed inlet channel 99 having the venturi housing assembly 20 extending externally about the inlet channel 99. Air or other gases are fed into a venturi chamber 100 by the conduit 16 from the gas source 14. The air or oxygen is drawn by the venturi effect through an annular channel 102 encircling the inlet opening 22 into the inlet channel 99 so that the liquid and gas are simultaneously drawn into the impeller chamber 96.

The venturi housing 20 is formed in two halves including an inlet orifice part 104 mounted by bolts 106 on the lower housing portion 38. The inlet orifice part 104 has the inlet 22 formed therein, surrounded by a funnel-shaped or flared wall 108.

In FIG. 3 is shown a view of the lower portion of the pump housing 38 with the annular channel 102 encircling the inlet orifice 22 at the lower side of the venturi housing 20. The air or oxygen conduit 16 is connected to the venturi housing 20 at the flange 18. In the illustrated embodiment, four support legs 40 are provided.

With reference to FIG. 4, the internal structure of the venturi housing 20 can be seen, including the chamber 100 encircling the inlet channel 99, support vanes 110 extend vertically at equally spaced locations about the annular chamber 102. Referring back to FIG. 2, the chamber 100 has a greater vertical dimension at the side adjacent the flange 18 that at the side opposite the flange 18. This provides a preferably steadily decreasing cross section in the chamber 100 so that relatively constant air pressure is maintained all the way around the annular channel 102.

In FIG. 5 is shown a cross section generally through the impeller chamber 96 showing the impeller blades 90 having curved surfaces on the impeller 80. The mismatched character of the impeller 80 relative to the impeller chamber 96 is readily apparent by examining FIGS. 2 and 5. Behind, or above depending upon the Figure being view, the impeller 80 is in the outlet chamber 64 from which extends the outlet 66 to the nozzle 36. The illustrated impeller has forward curved vanes or blades 90, although both radial or backward curved vanes may be used and are within the scope of the invention.

The impeller as shown in FIG. 5 is driven by the motor unit 28 to rotate in a counter-clockwise direction, viewed from the inlet, to centrifugally drive the liquid and gas mixture upward into the toroidal outlet chamber 64 and through the outlet 66 to the nozzle 36. The device could be designed, however, to run in a clockwise direction. The flow through the reduced diameter nozzle orifice 72 causes a back pressure in the impeller chamber 96 and outlet chamber 64, thereby increasing retention time of the gas and liquid mixture therein. The increased pressure also permits the liquid to absorb a greater quantity of the gas than it would at lower pressures. The rotating impeller also highly agitates the mixture to break up larger gas bubbles and further promote absorption.

As the air and gas mixture is pumped from the impeller chamber 96, a lowered pressure therein draws in liquid through the inlet 22 and along the inlet channel 99. The liquid flow along the liquid channel draws the gas in the venturi chamber 100 through annular channel 102 and into the flow. Thus, a renewed supply of liquid and gas mixture is constantly and automatically being drawn into the oxygenator 12 as the agitated and pressurized mixture is ejected.

The ejection of the mixture from the nozzle 36 is preferably in a downward direction and, as shown, is also provided with a tangential component of motion to facilitate mixing of the liquid within the tank 10, prevent settling, and enable any undissolved gas bubbles to travel the maximum distance to the liquid level 32.

The operation of the present pump is different than in the known devices. In particular, the present oxygenator 12 has a larger capacity than previous units but the impeller is rotated at the same high speed, rather than at a lower speed, which is the conventional wisdom for large capacity pumps. For effective operation, discharge head, or pressure at the discharge nozzle 36, must be within an optimal range. To achieve these operating characteristics, the specific speed must be high, for example in the range of 3500. Specific speed N is calculated from the formula:

$$N = \frac{n\sqrt{Q}}{H^{\frac{3}{4}}}$$

where N is specific speed, n is speed in rpm, Q is capacity in gam, and H is head in feet.

The advantages of the recent invention will become further apparent by examination of the following table, wherein a known oxygenator A is compared to a larger oxygenator B of similar design which is run at a slower speed in accordance with the conventional wisdom, and to a high specific speed oxygenator C of the present invention.

| | A | B | C |
|---|---|---|---|
| Specific speed, approx. | 1700 | 1700 | 3500 |
| Design flow rate, gpm | 300 | 1200 | 1200 |
| Discharge head, ft. | 45 | 45 | 45 |
| Rotative speed, rpm | 1770 | 885 | 1770 |
| Impeller dia. in. | 7.8 | 15.6 | 8.0 |
| Relative cost* $f_e$ | 1.0 | 7.0 | 3.4. |
| Motor horsepower | 8.2 (50% eff.) | 24.8 (55% eff.) | 22.7 (60% eff.) |

The relative cost (approx.) $f_c$ is derived from the formula: $f_c$(impeller diameter ratio)×(motor horsepower ratio) ×(pump capacity ratio)

For pump B, the relative cost $f_c$=

$$\left(\frac{15.6}{7.8}\right)\left(\frac{24.8}{8.2}\right)^{\frac{1}{2}}\left(\frac{1200}{300}\right)^{\frac{1}{2}} = 7.$$

while for the present pump C $f_c$=

$$\left(\frac{8.0}{7.8}\right)\left(\frac{22.7}{8.2}\right)^{\frac{1}{2}}\left(\frac{1200}{300}\right)^{\frac{1}{2}} = 3.4.$$

thus indicating size, weight and cost efficiency.

Thus, it will be seen that the relative cost of the present type C oxygenator is approximately one half of that of the type B oxygenator. Further, while the relative cost of the C oxygenator is 3.4 times more than the A oxygenator, its increased flow rate is 4 times more than the A oxygenator thereby provided substantial operating cost savings over both prior designs.

Although other modifications and changes may be suggested by those skilled in the art, it is the intention of the inventors to embody within the patent warranted hereon all changes and modifications as reasonably and properly come within the scope of their contribution to the art.

I claim:

1. A high specific speed centrifugal pump for mixing a first and second fluid, comprising:

an inlet into said pump through which said first fluid is drawn;

means for injecting said second fluid into a flow of said first fluid being drawn into said inlet;

a pump chamber of a frusto-conical shape formed by a conical wall and a cylindrical wall, said inlet being at a frustrum of said pump chamber;

an outlet of said pump chamber at a base of said frusto-conical pump chamber; and an impeller having blades of an effective fluid moving width mounted for rotation in said pump chamber, said impeller being mismatched to said pump chamber with said blades spaced from said conical wall of said pump chamber by a distance in the range of between approximately one and a third and four times said effective width of said blades; and a motor connected to said impeller for rotating said impeller in said chamber at a specific speed of at least about 3,500 r.p.m.

2. A high specific speed centrifugal pump as claimed in claim 1, wherein said impeller rotates on an axis, and said impeller lies on said axis intermediate said inlet and said outlet in a direction on said axis.

3. A high specific speed centrifugal pump as claimed in claim 1, wherein said outlet of said pump chamber is in a toroidal shaped outlet chamber.

* * * * *